US011814212B2

(12) United States Patent
Oakes

(10) Patent No.: US 11,814,212 B2
(45) Date of Patent: Nov. 14, 2023

(54) RECLOSABLE CUP LID WITH SLIDING MEMBER

(71) Applicant: GPCP IP Holdings LLC, Atlanta, GA (US)

(72) Inventor: Shawn A. Oakes, Ripon, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 325 days.

(21) Appl. No.: 15/480,143

(22) Filed: Apr. 5, 2017

(65) Prior Publication Data

US 2018/0289185 A1 Oct. 11, 2018

(51) Int. Cl.

| | |
|---|---|
| ***A47G 19/22*** | (2006.01) |
| ***B65D 21/02*** | (2006.01) |
| ***B65D 51/18*** | (2006.01) |
| ***B65D 43/20*** | (2006.01) |
| ***B65D 43/06*** | (2006.01) |
| ***B65D 47/28*** | (2006.01) |
| ***B65D 43/02*** | (2006.01) |

(52) U.S. Cl.

CPC ..... *B65D 21/0223* (2013.01); *B65D 43/0208* (2013.01); *B65D 43/065* (2013.01); *B65D 43/20* (2013.01); *B65D 47/286* (2013.01); *B65D 51/18* (2013.01); *B65D 2251/009* (2013.01); *B65D 2251/0018* (2013.01); *B65D 2251/0028* (2013.01); *B65D 2251/0081* (2013.01); *B65D 2543/00027* (2013.01); *B65D 2543/00046* (2013.01); *B65D 2543/00092* (2013.01); *B65D 2543/00296* (2013.01)

(58) Field of Classification Search

CPC ..... B65D 21/0223; B65D 43/0208; B65D 43/065; B65D 43/20; B65D 47/286

USPC ..... 220/254.9, 711; 229/404; 206/508

See application file for complete search history.

(56) References Cited

U.S. PATENT DOCUMENTS

| | | | | |
|---|---|---|---|---|
| 1,153,379 | A * | 9/1915 | Frankenberg | B65D 47/265 222/545 |
| 2,304,898 | A | 12/1942 | Dukehart | |
| 3,065,875 | A | 11/1962 | Negoro | |
| 3,174,661 | A | 3/1965 | Speicher | |
| 3,338,468 | A * | 8/1967 | Wilson | B65D 21/0219 206/508 |
| 3,659,758 | A | 5/1972 | Waterman | |
| 4,170,724 | A | 10/1979 | Waterbury | |
| 4,441,623 | A | 4/1984 | Antoniak | |
| 4,570,817 | A | 2/1986 | Hambleton et al. | |
| 4,819,829 | A | 4/1989 | Rosten | |
| 5,086,941 | A | 2/1992 | English et al. | |

(Continued)

FOREIGN PATENT DOCUMENTS

| | | |
|---|---|---|
| WO | 2010/069043 | 6/2010 |

*Primary Examiner* — Robert Poon

(57) ABSTRACT

Reclosable cup lids are provided herein. The reclosable cup lid can have a rim portion defining an outer perimeter. A sidewall can extend upwardly from the rim portion, and an upper surface can slope from a first end thereof to a second end thereof. A cavity can be disposed within the sidewall and above the upper surface. A drink aperture can be disposed within the cavity and formed through at least a portion of the upper surface to allow fluid flow therethrough. A slideable tab can be at least partially disposed within the cavity that can have at least two opposing sides that are generally straight, providing a track for the slideable tab.

18 Claims, 6 Drawing Sheets

(56) References Cited

U.S. PATENT DOCUMENTS 5,390,828 A 2/1995 Gross
5,462,189 A * 10/1995 Pierce ..... B65D 47/089 220/815
5,509,568 A 4/1996 Warden et al.
5,538,156 A 7/1996 Proshan
5,553,731 A 9/1996 Schuyler
5,624,053 A 4/1997 Freek et al.
5,938,062 A 8/1999 Paramski
6,419,112 B1 7/2002 Bruce et al.
6,431,390 B1 8/2002 Waller
6,439,442 B1 8/2002 Markert et al.
6,732,882 B2 5/2004 Belcastro
6,752,287 B1 6/2004 Lin
6,889,859 B1 5/2005 Leon
7,134,570 B1 11/2006 Heath et al.
7,185,781 B2 3/2007 Pitts
7,275,653 B2 10/2007 Tedford, Jr.
7,591,389 B2 9/2009 Wong
7,611,029 B2 11/2009 Wong
7,753,224 B2 * 7/2010 Cai ..... B65D 47/286 220/212
7,845,510 B2 12/2010 Schmidtner et al.
7,850,037 B2 12/2010 Schmidtner et al.
7,874,447 B2 1/2011 Schmidtner et al.
7,959,029 B2 6/2011 Whitaker et al.
8,313,002 B2 11/2012 Tokunaga
8,733,583 B2 5/2014 Bailey
8,919,593 B2 12/2014 Sinacori et al.
9,010,567 B2 * 4/2015 Pink ..... B65D 43/0212 220/253
D734,092 S 7/2015 Kristinik
9,096,358 B2 8/2015 Bailey
9,145,238 B2 9/2015 Barreto et al.
9,238,529 B1 * 1/2016 Newman ..... B65D 43/12
D751,338 S 3/2016 Seiders et al.
D751,339 S 3/2016 Seiders et al.
D751,340 S 3/2016 Seiders et al.
D751,341 S 3/2016 Seiders et al.
9,351,597 B2 5/2016 Liu et al.
D761,619 S 7/2016 Seiders et al.
9,492,033 B2 11/2016 Abrams et al.
9,565,958 B2 2/2017 Liu et al.
9,580,229 B2 2/2017 Thomas
D790,272 S 6/2017 Han
2006/0201945 A1 * 9/2006 Tedford, Jr. ..... B65D 47/286 220/254.9
2008/0190946 A1 * 8/2008 Wong ..... B65D 47/286 220/711
2010/0163558 A1 7/2010 Karam
2012/0267384 A1 10/2012 Bye et al.
2014/0166659 A1 * 6/2014 Antal, Sr. ..... B65D 43/0256 220/521
2015/0201777 A1 7/2015 Kim
2015/0272359 A1 * 10/2015 Oakes ..... B65D 39/00 220/254.1
2017/0121072 A1 5/2017 Seiders et al.
2017/0121074 A1 5/2017 Seiders et al.

* cited by examiner

RECLOSABLE CUP LID WITH SLIDING MEMBER

BACKGROUND

Field

Embodiments described generally relate to disposable cup lids, and more particularly, to a disposable cup lid having a reclosable, slideable drink opening cover.

Description of the Related Art

In general, a disposable cup lid is secured over a disposable cup to limit heat transfer of its contents (e.g. beverage) as well as to minimize spillage of the contents out of the cup. The lid typically has a preformed opening that allows a user to drink the beverage without having to remove the lid from the cup. Nonetheless, the contents may spill out of the lid opening if the cup is bumped or overturned.

A variety of lids are used to minimize spillage. Some conventional lids have a separate piece or component to cover the drink opening when the user is not drinking the beverage. In some lids, the separate piece is sized and shaped to fit within the drink opening as serves as a plug. Other lids have used a resealable flap that is secured at one end to the lid body and have a second end that may be either pushed into the drink opening. Other lids have used a removable plug or flap that may be removed entirely from the lid to access the drink opening. Other types of lids have employed a slideable cover that the user moves to provide access to the drink opening.

One difficulty in designing cup lids to minimize spillage is the ability to stack lids one on top of another during manufacture, storage, display, and point of use. Another difficulty in designing cup lids to minimize spillage is the ability to stack and carry two or more assembled cups and lids on top of one another, with enough stability and confidence as not to drop the stack on the floor.

There is still a need, therefore, for a disposable and reclosable cup lid that protects the user against spillage and provides ease of stackability and/or portability when the user has more than one beverage cup to carry.

SUMMARY

Reclosable cup lids are provided herein. In at least one specific embodiment, the reclosable cup lid includes a rim portion defining an outer perimeter; a sidewall that extends upwardly from the rim portion; an upper surface that slopes from a first end thereof to a second end thereof; a cavity disposed within the sidewall and above the upper surface; a drink aperture disposed within the cavity and formed through at least a portion of the upper surface to allow fluid flow therethrough; and a slideable tab at least partially disposed within the cavity, wherein the cavity has at least two opposing sides that are generally straight, providing a track for the slideable tab.

In at least one other specific embodiment, the reclosable cup lid can include a rim portion defining an outer perimeter; a sidewall that extends upwardly from the rim portion; an upper surface disposed within the sidewall that slopes from a first end thereof to a second end thereof; a cavity disposed within the sidewall and above the upper surface, the cavity having at least two opposing sides that are generally straight and generally parallel; a drink aperture disposed within the cavity and formed through at least a portion of the upper surface to allow fluid flow therethrough; a slideable tab at least partially disposed within the cavity, the slideable tab having at least two generally straight and generally parallel sides, wherein the at least two opposing sides of the cavity that are generally straight and generally parallel provide a track for the slideable tab to move across; and a shoulder disposed within an inner portion of the sidewall and proximate the generally straight and generally parallel sides of the cavity, wherein the sidewall entirely surrounds the upper surface and includes a generally flat top portion.

In at least one other specific embodiment, the reclosable cup lid can include a rim portion defining an outer perimeter; a sidewall that extends upwardly from the rim portion; an upper surface disposed within the sidewall that slopes from a first end thereof to a second end thereof, wherein the sidewall entirely surrounds the upper surface; a cavity disposed within the sidewall and above the upper surface, the cavity having at least two opposing sides that are generally straight and generally parallel; a drink aperture disposed within the cavity and formed through at least a portion of the upper surface to allow fluid flow therethrough; a slideable tab at least partially disposed within the cavity, the slideable tab having at least two generally straight and generally parallel sides, wherein the at least two opposing sides of the cavity that are generally straight and generally parallel provide a track for the slideable tab; a shoulder disposed within an inner portion of the sidewall and proximate the generally straight and generally parallel sides of the cavity; and three or more positioning members disposed on a generally flat top surface of the sidewall, wherein the positioning members are arranged to provide engagement with a circular profile of a cup bottom.

DETAILED DESCRIPTION

Figure 1:
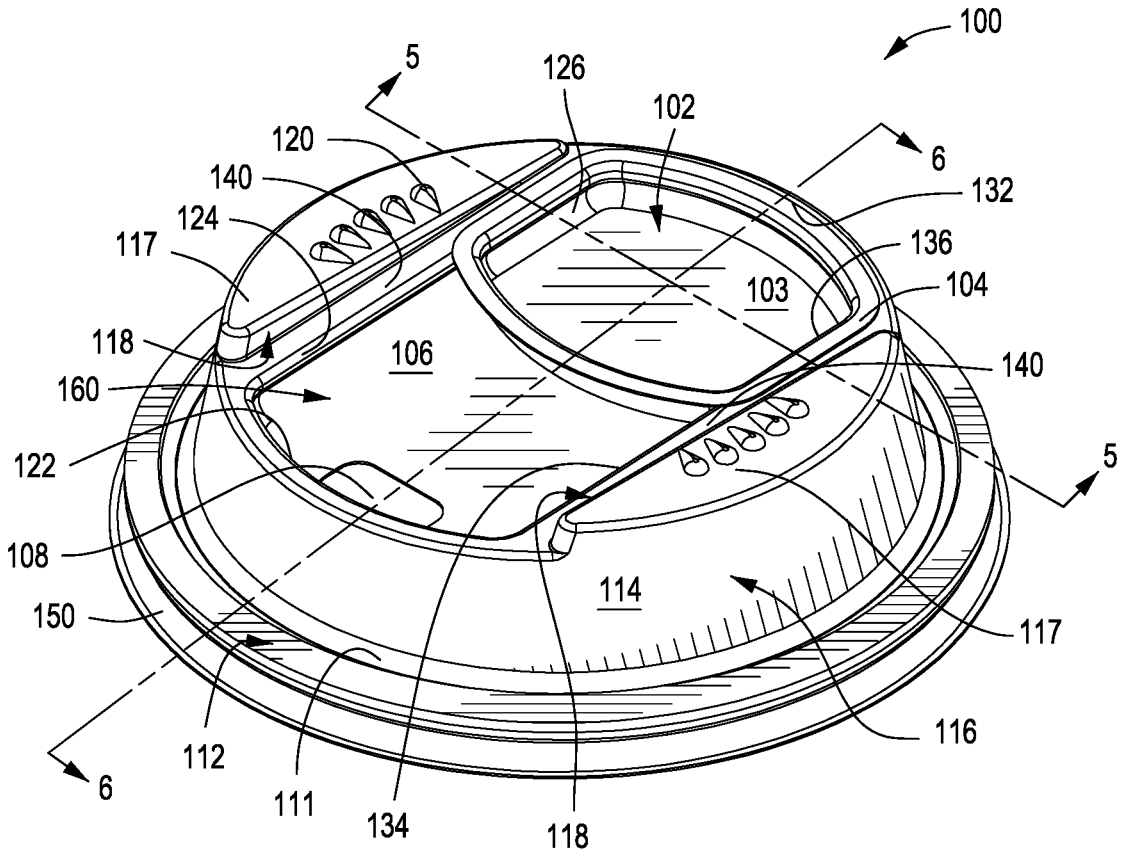
FIG. 1 depicts a perspective view of an illustrative lid, according to one or more embodiments described herein.

FIG. 1 depicts a perspective view of a reclosable lid 100, according to one or more embodiments. The reclosable lid 100 can include a slideable member or tab 102, an upper surface 106, a drink aperture 108 formed through the upper surface 106, a rim portion 112 located about the outer perimeter of the lid 100, and a sidewall 116. The rim portion 112 extends from the sidewall 116 and defines the outer perimeter of the reclosable lid 100.

The sidewall 116 can have an outer portion 114, a top portion 117, and an inner portion 118. The outer portion 114 of the sidewall 116 is generally round and can extend upwardly from the rim portion 150. The outer portion 114 of the sidewall 116 can transition to the top portion 117 using one or more transitions. Such one or more transitions can be curved, squared or have any other suitable shape or profile, or combinations thereof.

The top portion 117 of the sidewall 116 provides the uppermost surface of the lid 100. The top portion 117 can be a generally flat or planar surface. The top portion 117 of the sidewall 116 also can be generally horizontal. The top portion 117 of the sidewall 116 can provide a flat surface or platform for a cup (not shown) to be placed and supported thereon.

The top portion 117 of the sidewall 116 can transition to the inner portion 118 using one or more transitions. Such one or more transitions can be curved, squared or have any other shape or profile, or combinations thereof. The inner portion 118 of the sidewall 116 can surround the drink aperture 108. The inner portion 118 of the sidewall 116 also can define or otherwise provide a channel or cavity 160, which can be centrally located within the lid 100 as depicted in FIG. 1. Although the channel or cavity 160 is depicted as being centrally located, it can be located anywhere on the upper surface 106 of the lid 100. The channel or cavity 160 can have any suitable shape or configuration, including circular, rounded, elliptical, oval, squared, rectangular, or polygonal. For clarity and ease of description, however, the channel or cavity 160 will be further described with reference to the specific embodiment depicted in FIG. 1.

As depicted in FIG. 1, for example, the channel or cavity 160 can be oval shaped having have two opposing sides 122, 132 that are generally round or otherwise have a radius of curvature, and two opposing sides 124, 134 that are generally straight. The two opposing sides 124, 134 that are generally straight also can be generally parallel to one another. The channel or cavity 160 can have any suitable depth, length, or width, depending on the overall size of the lid 100. As depicted in FIG. 1, the slideable tab 102 can at least partially fit within the channel or cavity 160, above the upper surface 106, and can be configured to move or slide about the upper surface 106 to block or unblock the drink aperture 108. The channel or cavity 160 can also serve as a reservoir to contain a spillage in the event the beverage sloshes out of a cup during use.

To facilitate the movement of the slideable tab 102, the two opposing sides 124, 134 that are generally straight can be configured to provide slide tracks. The slideable tab 102 can be configured to slide or otherwise move back and forth linearly, in a straight line. All or any portion of the cross section of the sides 124, 134 can be S-shaped, C-shaped or any other suitable curved, non-straight profile including profiles similar to an S-shape, such as in the shape of the number 5. All or any portion of the cross section of the slideable tab 102 also can be profiled to match or otherwise correspond to the profile of the opposing sides 124, 134 of the channel or cavity 160, as explained in more detail below with reference to FIGS. 2-5. Such profiles, therefore, can exist along the entire length of the sides 124, 134 and/or cavity 160, or the profiles can be non-continuous or interrupted along the length of the sides 124, 134 and/or cavity 160, or any combination thereof.

Figure 2:
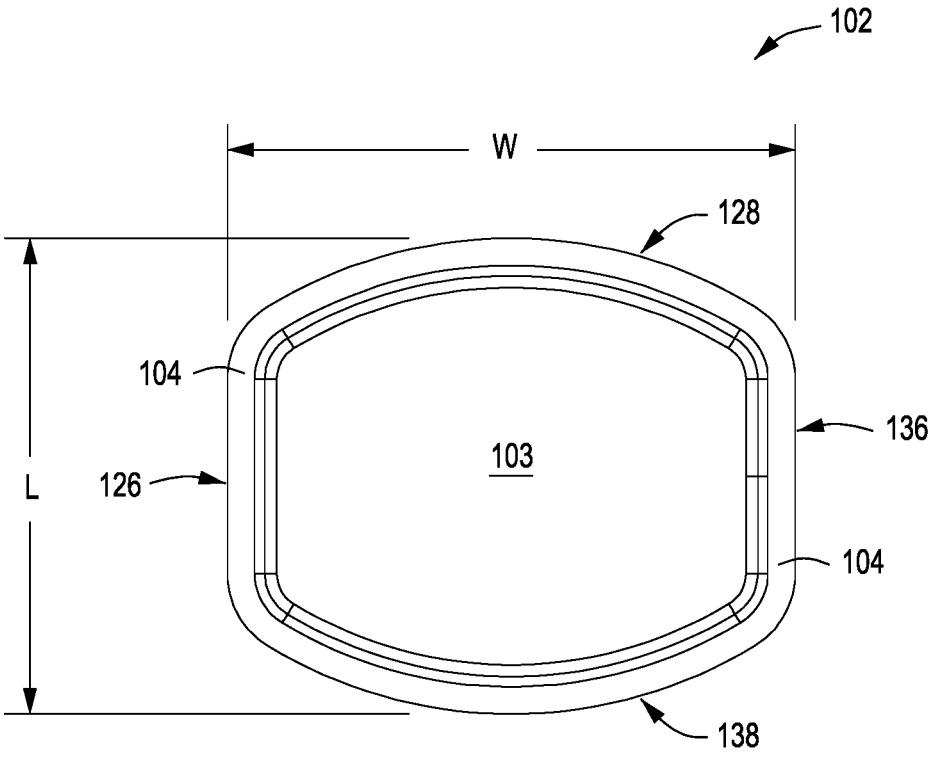
FIG. 2 depicts a plan view of the slideable tab shown in FIG. 1.
Figure 3:
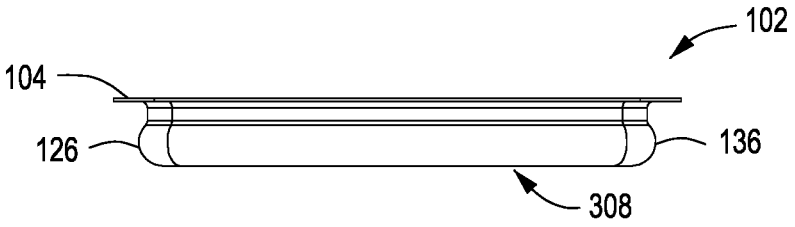
FIG. 3 depicts a side elevation view of the slideable tab in FIG. 2.

FIG. 2 depicts an enlarged plan view of the slideable tab 102 and FIG. 3 depicts a side elevation view thereof. The slideable tab 102 can include a first set of opposing sides 126, 136 that can be generally parallel, and a second set of opposing sides 128, 138 that can be generally round, generally straight, or a combination thereof (shown as generally round in FIG. 2). The slideable tab 102 also can include a recessed upper surface 103 to provide a recessed inner portion to provide additional room for a user's nose when drinking from the lid 100.

A lower portion 308 of the slideable tab 102 can be curved or bulbous, as depicted in FIG. 3. In one embodiment, a cross section of the sides 128, 138 of the slideable tab 102 can be profiled to match or otherwise correspond to the profile of the opposing sides 124, 134 of the channel or cavity 160. For example, the lower portion 308 of the slideable tab 102 can have a S-shaped, C-shaped or any other suitable curved, non-straight profile including profiles similar to an S-shape, such as in the shape of the number 5, that complement the profile of the sides 124, 134 of the channel or cavity 160. Such non-straight profiles can create or otherwise provide a substantially fluid tight engagement with the slideable tab 102, yet allow the slideable tab 102 to move across the upper surface 106 of the lid 100 within the cavity 160.

Figure 4:
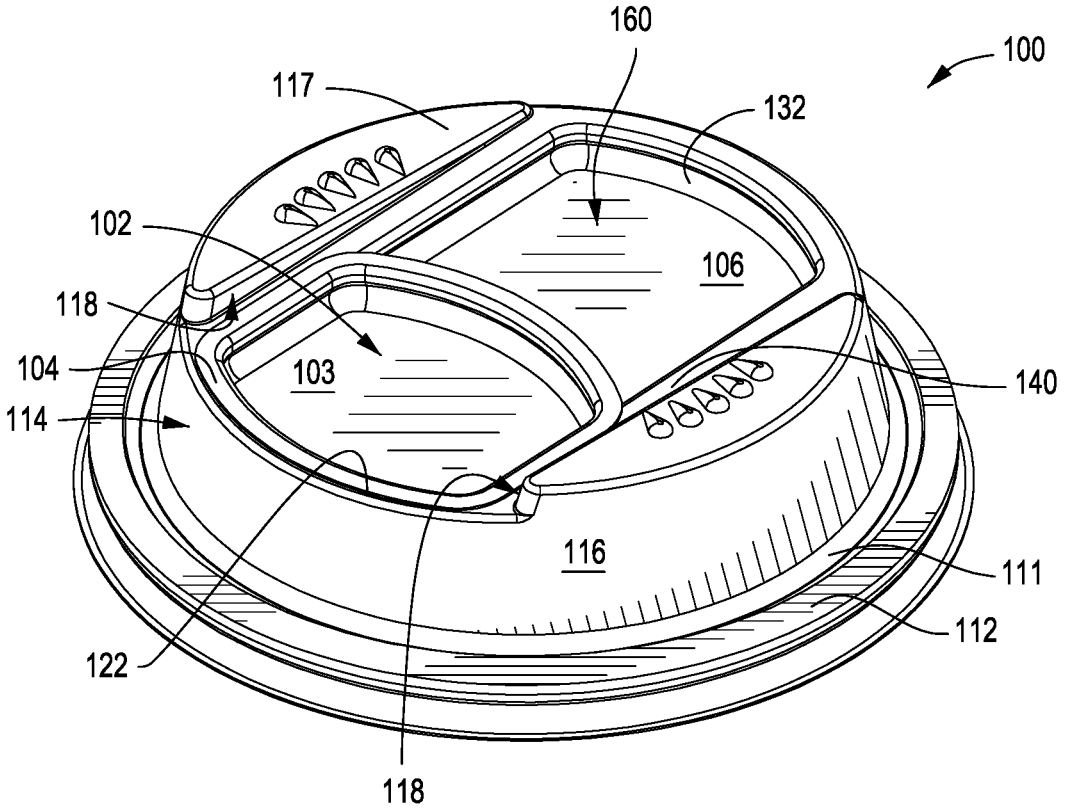
FIG. 4 depicts another perspective view of the lid shown in FIG. 1.

A shoulder 140 can be formed between cavity 160 and the inner portion 118 of the sidewall 116. The shoulder 140 can be a generally planar or otherwise flat surface adjacent surrounding one or more sides of the cavity 160. In FIGS. 1 and 4, the shoulder 140 is shown adjacent the generally straight sides 124, 134 of the cavity 160. The shoulder 140 can be generally horizontal or sloped toward the drinking aperture 108.

The slideable tab 102 can include a lip or overhang 104 configured to rest on or sit above the shoulder 140. If present, the overhang 104 can be formed on all four sides 126, 128, 136, 138 of the slideable tab 102, or at least along the two generally parallel sides 126, 136. The overhang 104 can be generally flat or planar on both its upper and lower sides. The width of the overhang 104 can correspond to the width of the shoulder 140, which provides an additional sliding surface for the slideable tab 102.

FIG. 4 depicts a perspective view of the illustrative reclosable lid in FIG. 1 in the second or closed position. Referring to FIGS. 1-4, the overhang 104 of the slideable tab 102 may sit on and may be supported by the shoulder 140. The frictional engagement between the lower portion 308 of the slideable tab 102 and the sides 124, 134 of the channel or cavity 160 allows the tab 102 to slide within the channel 160 from the back or first opposing end 132 of the channel 160 to the front or second opposing end 122 of the channel 160, thereby covering the drink aperture 108, and minimizing the spillage of any liquid contained within a cup (not shown). In use, the slideable tab 102 can move or otherwise slide within the channel 160 from a first position to fully cover the drink aperture 108 to a second position to fully uncover the drink aperture 108, or any position therebetween to control the opening size of the drink aperture 108. Although not shown, the underside of the slideable tab 102 can include a protrusion or extension that is sized and shaped to fit within the drink aperture 108, creating an audible or sensory positioning indication to a user when the slideable tab 102 is in the fully closed position.

Figure 5:
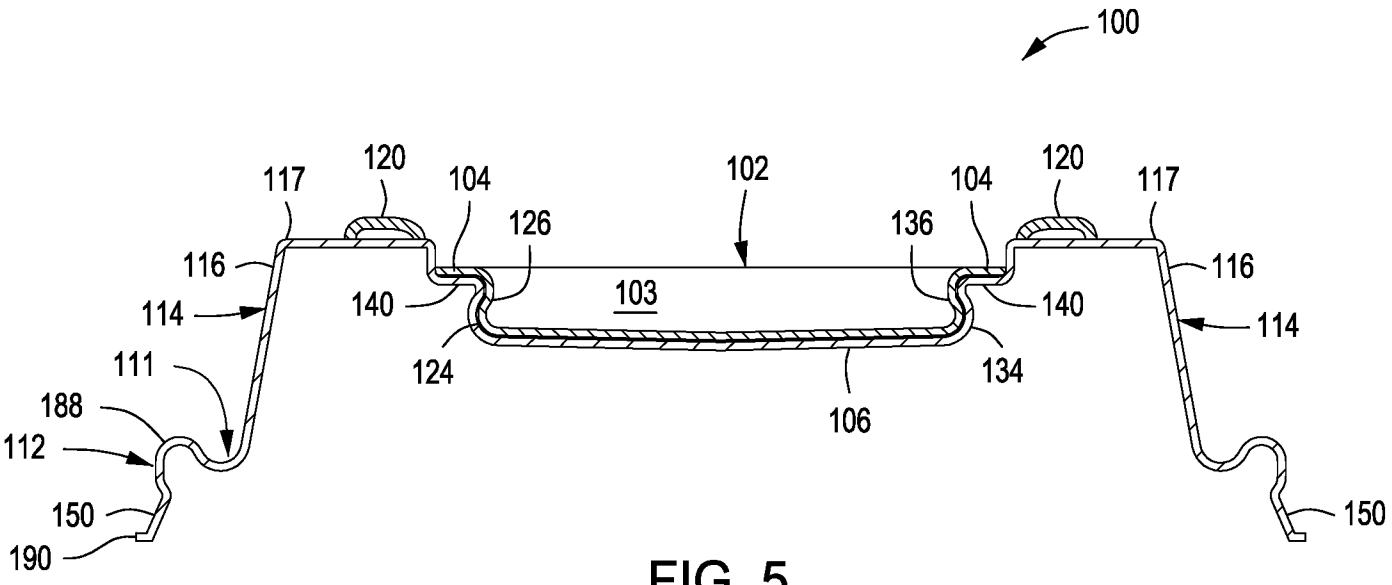
FIG. 5 depicts an illustrative partial sectional view of the lid taken along lines 5-5 in FIG. 1.

FIG. 5 depicts an illustrative cross-sectional view of the reclosable lid 100 along lines 5-5 of FIG. 1. As shown in FIG. 5, the shoulder 140 can act as an additional support or guide for the slideable tab 102. Accordingly, when a front end of the slideable tab 102 abuts the front or first end 122 of the channel 160, the slideable tab 102 can completely cover the drink aperture 108, as depicted in FIG. 4. Conversely, when a back end of the slideable tab 102 abuts the back or second end 132 of the channel 160, the drink aperture 108 can be wholly unobstructed, as depicted in FIG. 1, thereby allowing any liquid contained within the cup to freely flow therethrough. In one embodiment, the overhang 104 on the slideable tab 102 can be configured to slide back and forth, linearly, over the shoulder 140 and within the cavity 160. Hence, the shoulder 140 serves as a guide upon which the overhang 104 of the tab 102 can be positioned upon. In another embodiment, where the slideable tab 102 may not include the overhang 104, the tab 102 can be positioned within the adjoining sides 124, 134 of the cavity 160 and held in place due to a friction fit therewith.

Figure 6:
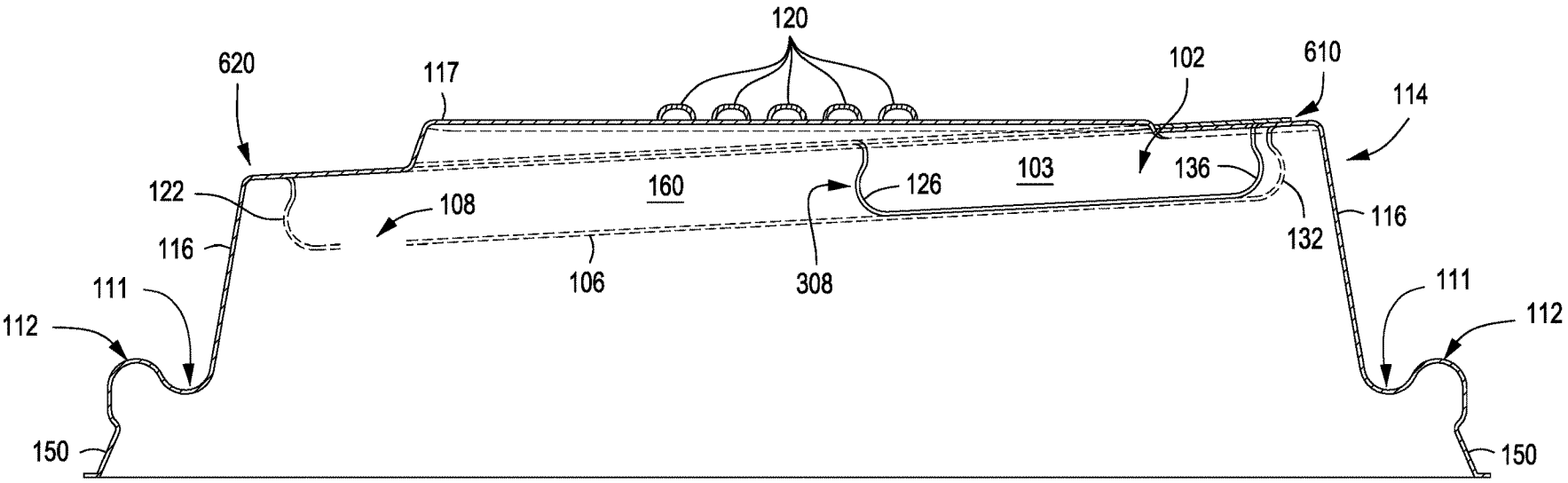
FIG. 6 depicts an illustrative partial sectional view of the lid taken along lines 6-6 in FIG. 1.

FIG. 6 depicts a cross-sectional view of a portion of the reclosable lid 100 along lines 6-6 of FIG. 1. As depicted, the upper surface 106 can be sloped from a second end 610 of the lid 100 that is furthest from the drinking aperture 108 toward a first end 620 of the lid 100 that is closest to the drinking aperture 108. As such, the channel or cavity 160 is sloped in a similar fashion. Any suitable degree of slope can be used, but preferably the slope is about 1° to 20° relative to horizontal, and more preferably 2° to 8°. The slope can allow fluid on the upper surface 106, within the channel 160, to flow back through the aperture 108 into a cup (not shown) therebelow.

In certain embodiments, the shoulder 140 or the top portion 117 of the sidewall 116 or both can be sloped like the upper surface 106 of the lid 100. The shoulder 140 or the top portion 117 of the sidewall 116 or both can have the same degree of slope as the upper surface 106, or each can be different. The suitable degree of slope can contribute to maintaining a seal of the drink aperture 108 with the slideable tab 102 positioned over the drink aperture 108. For example, the degree of slope of the shoulder 140 can be more or less than the degree of slope of the upper surface 106 of the lid 100. In some embodiments, the degree of slope of the top portion 117 of the sidewall 116 can be more or less than the degree of slope of the upper surface 106 of the lid and/or the shoulder 140. The differences in degree of slope can range anywhere from plus or minus 1° to plus or minus 10°, such as plus or minus 7°, 5°, or 3°.

Referring again to FIG. 2, the slideable tab 102 can have a length (L) and a width (W). In some embodiments, the length L of the tab 102 can range from a low of about 0.8 inches, 0.9 inches, 1.1 inches, 1.15 inches, 1.2 inches, 1.25 inches, or 1.3 inches, to a high of about 1.35 inches, 1.55 inches, 1.75 inches, 1.85 inches, 1.95 inches, or 2.1 inches. For example, the length L of the tab can range from about 0.9 inches to 2.1 inches, 1.05 inches to 1.5 inches, 1.2 inches to 1.45 inches, 1.25 inches to 1.4 inches, or 1.3 inches to 1.35 inches. The width W of the tab 102 can range from a low of about 0.9 inches, 1.1 inches, 1.35 inches, 1.4 inches, 1.45 inches, 1.5 inches, or 1.55 inches, to a high of about 1.6 inches, 1.65 inches, 1.7 inches, 1.75 inches, 1.8 inches, 1.9 inches, or 2.0 inches. For example, the width W of the tab 102 can range from about 0.9 inches to 2.0 inches, 1.1 inches to 1.75 inches, 1.45 inches to 1.7 inches, 1.5 inches to 1.65 inches, or 1.55 inches to 1.6 inches.

The drink aperture 108 can be disposed on the upper surface 106, and can be located proximate the front end 122 of the channel 160. The drink aperture 108 can allow fluid within the cup to flow therethrough, and can be formed through at least a portion of the upper surface 106 of the lid 100. The drink aperture 108 can have a variety of shapes, including, but not limited to, circular, elliptical, a polygonal shape such as a triangle, a square, a rectangle, or a trapezoid, or any combination thereof. The size or area of the drink aperture 108 can be any suitable size, and may be about 10 $mm^2$, about 25 $mm^2$, about 50 $mm^2$, about 75 $mm^2$, or about 100 $mm^2$ to about 125 $mm^2$, about 150 $mm^2$, about 175 $mm^2$, about 200 $mm^2$, or more. For example, the size of the drink aperture 108 can be about 25 $mm^2$ to about 75 $mm^2$, about 50 $mm^2$ to about 100 $mm^2$, about 75 $mm^2$ to about 125 $mm^2$, about 100 $mm^2$ to about 150 $mm^2$, about 125 $mm^2$ to about 175 $mm^2$, about 150 $mm^2$ to about 200 $mm^2$, or about 50 $mm^2$ to about 200 $mm^2$.

Referring again to FIGS. 1 and 4, one or more positioning members 120 can be disposed or otherwise formed on the top portion 117 of the sidewall 116. The one or more positioning members 120 can be located anywhere on the top portion 117 of the sidewall 116, in any suitable pattern, and in any suitable frequency. Four positioning members 120 are shown in FIGS. 1 and 4 on each side of the top portion 117 of the sidewall 116. The positioning members 120 can be any suitable embossed or raised profile, in any shape, to provide a catch or engagement for a cup (not shown) that is placed on top of the lid 100. The positioning members 120 can provide more secure transport of two cups in tandem. For example, the positioning members 120 can be arranged in a semi-circle or an arc pattern, such as depicted in FIG. 1, for the purpose of providing engagement with a circular profile in a complimentary cup bottom.

Any suitable number of positioning members 120 can be used. The number of positioning members 120, for example, can range from 1 to 20, 2 to 18, 4 to 16, 6 to 14, 8 to 12, or from 4 to 6. The positioning members 120 also can be a variety of shapes, including, but not limited to, teardrop, rectangular, square, circular, curvilinear, arched, oval, or any combination thereof.

Referring again to FIGS. 5 and 6, the rim portion 112 can include a generally annular sealing groove 188 disposed proximate an outer skirt 150. A recessed annular channel or surface gap 111 can be located adjacent to the sealing groove 188. The sealing groove 188 is configured to engage a brim of a cup (not shown) and form a seal therebetween, minimizing spillage, if not preventing spillage, of any liquid contained in the cup. A generally annular flared trim 190 can extend from the rim portion 112. The flared trim 190 can provide a gripping surface for a user to remover or apply the lid 100 to a cup (not shown) during use.

Figure 7:
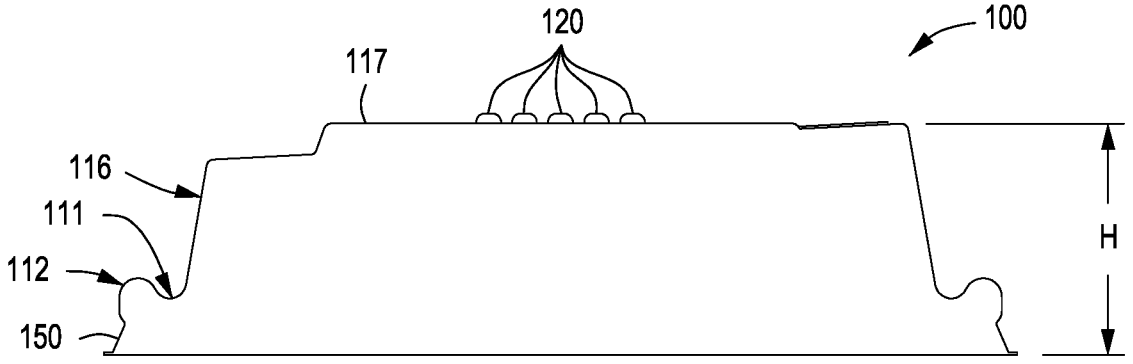
FIG. 7 depicts a schematic side elevation view of the lid in FIG. 1.

FIG. 7 depicts a side elevation view of the lid 100. The height H of the lid 100 can vary. The height H of the lid 100 can also vary from a first end thereof, adjacent the drinking aperture 108, to a second end thereof, opposite of the aperture 108. The height H of the lid 100, for example, can range from a low of about 0.75 inches, 0.80 inches, or 0.85 inches to a high of about 0.90 inches, 0.95 inches, or 1.0 inch. The height H of the lid 100 also can range from about 0.75 inches to 1.0 inch, 0.80 inches to 0.95 inches, or from about 0.85 inches to 0.90 inches.

The lid 100 can be manufactured by a variety of techniques, including thermoforming. However, forming techniques other than thermoforming can also be used to manufacture the lid 100, including, but not limited to variations such as pre-softening an extruded sheet to temperatures below the final melting temperature, cutting flat sections (i.e. blanks) from the sheet, and the transfer of blanks by gravity or mechanical means into matched molds whereby the blanks are shaped into an article by heat and pressure. Moreover, other alternate arrangements can be used, including, but not limited to the use of drape, vacuum, pressure, free blowing, matched die, billow drape, vacuum snap-back, billow vacuum, plug assist vacuum, reverse draw with plug assist, pressure bubble immersion, trapped sheet, slip diaphragm, twin-sheet cut sheet, twin-sheet rolled forming, and any suitable combinations thereof.

The lid 100 can be made from one or more polymeric or plastic materials, including one or more polyolefins, such as polyethylenes, polypropylenes, and mixtures thereof, polyesters, polyamides, polystyrenes, polyacrylates, polysulfones, polyetherketones, polycarbonates, acrylics, polyphenylene sulfides, acetyls, cellulosics, polyether imides, polyphenylene ethers/oxides, styrene maleic anhydride copolymers, styrene acrylonitrile copolymers, polyvinyl chlorides, and engineered resin derivatives thereof.

The reclosable lid 100 can be generally round in shape, and can have any suitable diameter, for example, from a low of about 3.1 inches, 3.15 inches, 3.2 inches, 3.25 inches, 3.3 inches, 3.35 inches, or 3.4 inches to a high of 3.45 inches, 3.75 inches. 3.85 inches, 3.95 inches, 4.05 inches, 4.15 inches, or 4.25 inches. For example, the diameter of the reclosable lid 100 can range from about 3.1 inches to 4.25 inches, 3.1 inches to 3.7 inches, 3.2 inches to 3.65 inches, 3.25 inches to 3.6 inches, 3.3 inches to 3.55 inches, 3.35 inches to 3.5 inches, or 3.4 inches to 3.45 inches.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A reclosable cup lid, comprising:

a rim portion defining an outer perimeter;

a sidewall that extends upwardly from the rim portion;

an upper surface that slopes from a first end thereof to a second end thereof;

a cavity disposed within the sidewall and above the upper surface;

a drink aperture disposed within the cavity and formed through at least a portion of the upper surface to allow fluid flow therethrough;

a slideable tab at least partially disposed within the cavity, the slideable tab having at least two generally straight and generally parallel sides, wherein the cavity has at least two generally straight and generally parallel sides, providing a track for the slideable tab, and wherein the generally straight and generally parallel sides of both the slideable tab and the cavity have complementary cross-sectional profiles; and a shoulder disposed within an inner portion of the sidewall, the shoulder located above the cavity and proximate the generally straight and generally parallel sides of the cavity, wherein the slideable tab comprises an overhang configured to rest on an adjacent portion of the shoulder wherein a width of the overhang corresponds to a width of the shoulder to provide an additional sliding surface for the slideable tab, the additional sliding surface entirely surrounding the cavity.

2. The reclosable cup lid of claim 1, wherein the slideable tab is moveable from a first position to a second position, and wherein the drink aperture is at least partially blocked when the slideable tab is located in the first position, and wherein the drink aperture is at least partially unobstructed when the slideable tab is located in the second position.

3. The reclosable cup lid of claim 1, wherein the slideable tab further comprises a recessed upper surface.

4. The reclosable cup lid of claim 1, wherein the complementary cross-sectional profiles of the slideable tab and the cavity consist of curved surfaces that are configured to engage and provide a friction fit therebetween.

5. The reclosable cup lid of claim 1, wherein the complementary cross-sectional profiles of both the slideable tab and the cavity are S-shaped or C-shaped.

6. The reclosable cup lid of claim 1, wherein the overhang surrounds the slideable tab.

7. The reclosable cup lid of claim 6, wherein the shoulder and the overhang provide an additional guide mechanism for the slideable tab.

8. The reclosable cup lid of claim 1, wherein the upper surface slopes from the first end that is opposite the drink aperture toward the second end that is proximate the drink aperture.

9. The reclosable cup lid of claim 1, wherein the sidewall comprises a generally flat top portion.

10. The reclosable cup lid of claim 9, further comprising one or more positioning members disposed on the generally flat top portion of the sidewall.

11. The reclosable cup lid of claim 10, wherein each positioning member is a raised extension formed on the generally flat top portion of the sidewall.

12. The reclosable cup lid of claim 10, wherein the positioning members are arranged in an arc to provide engagement with a circular profile in a cup bottom that is stacked thereon.

13. The reclosable cup lid of claim 10, wherein each positioning member is shaped as a teardrop, rectangle, square, circle, curve, arc, oval, or any combination thereof.

14. A reclosable cup lid, comprising:

a rim portion defining an outer perimeter;

a sidewall that extends upwardly from the rim portion;

an upper surface disposed within the sidewall that slopes from a first end thereof to a second end thereof;

a cavity disposed within the sidewall and above the upper surface, the cavity having at least two opposing sides that are generally straight and generally parallel;

a drink aperture disposed within the cavity and formed through at least a portion of the upper surface to allow fluid flow therethrough;

a slideable tab at least partially disposed within the cavity, the slideable tab having at least two generally straight and generally parallel sides, wherein the at least two opposing sides of the cavity that are generally straight and generally parallel provide a track for the slideable tab to move across, the generally straight and generally parallel sides of both the slideable tab and the cavity have complementary cross-sectional profiles to provide a friction fit therebetween; and a shoulder disposed within an inner portion of the sidewall, the shoulder located above the cavity and proximate the generally straight and generally parallel sides of the cavity, wherein the at least two generally straight and generally parallel sides of the slideable tab have an overhang configured to rest on an adjacent portion of the shoulder, wherein a width of the overhang corresponds to a width of the shoulder to provide an additional sliding surface for the slideable tab, the additional sliding surface entirely surrounding the cavity, and wherein the sidewall entirely surrounds the upper surface and includes a generally flat top portion.

15. The reclosable cup lid of claim 14, wherein the complementary cross-sectional profiles of both the slideable tab and the cavity are S-shaped or C- shaped.

16. The reclosable lid of claim 14, wherein the overhang surrounds the slideable tab.

17. The reclosable cup lid of claim 14, wherein the upper surface slopes from the first end that is opposite the drink aperture toward the second end that is proximate the drink aperture.

18. A reclosable cup lid, comprising:

a rim portion defining an outer perimeter;

a sidewall that extends upwardly from the rim portion;

an upper surface disposed within the sidewall that slopes from a first end thereof to a second end thereof, wherein the sidewall entirely surrounds the upper surface;

a cavity disposed within the sidewall and above the upper surface, the cavity having at least two opposing sides that are generally straight and generally parallel;

a drink aperture disposed within the cavity and formed through at least a portion of the upper surface to allow fluid flow therethrough;

a slideable tab at least partially disposed within the cavity, the slideable tab having at least two generally straight and generally parallel sides, wherein the at least two opposing sides of the cavity that are generally straight and generally parallel provide a track for the slideable tab, the generally straight and generally parallel sides of both the slideable tab and the cavity have complementary cross-sectional profiles to provide a friction fit therebetween;

a shoulder disposed within an inner portion of the sidewall, the shoulder located above the cavity and proximate the generally straight and generally parallel sides of the cavity, wherein the at least two generally straight and generally parallel sides of the slideable tab have an overhang configured to rest on an adjacent portion of the shoulder, wherein a width of the overhang of the slideable tab corresponds to a width of the shoulder to provide an additional sliding surface for the slideable tab, the additional sliding surface entirely surrounding the cavity; and three or more positioning members disposed on a generally flat top surface of the sidewall, wherein the positioning members are arranged to provide engagement with a circular profile of a cup bottom.

* * * * *